US007370760B2

(12) United States Patent
Clough

(10) Patent No.: US 7,370,760 B2
(45) Date of Patent: May 13, 2008

(54) PACKAGE THAT INCLUDES A PLURALITY OF DISPOSABLE ABSORBENT ARTICLES

(75) Inventor: Jane Clough, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 411 days.

(21) Appl. No.: 11/107,075

(22) Filed: Apr. 15, 2005

(65) Prior Publication Data

US 2006/0231448 A1 Oct. 19, 2006

(51) Int. Cl.
*B65D 71/08* (2006.01)

(52) U.S. Cl. ..... 206/494; 206/497

(58) Field of Classification Search ..... 206/223, 206/494, 497, 581; 383/72, 73, 74, 75
See application file for complete search history.

(56) References Cited

U.S. PATENT DOCUMENTS 3,141,602 A 7/1964 Anderson
3,370,630 A 2/1968 Haugh
3,653,583 A 4/1972 Meyer
3,679,048 A * 7/1972 Fujio ..... 206/497
4,381,058 A 4/1983 Chaussadas et al.
4,509,570 A * 4/1985 Eby et al. ..... 141/390
4,696,050 A 9/1987 Sengewald
4,878,764 A 11/1989 Meyer
4,966,286 A 10/1990 Muckenfuhs
5,036,978 A 8/1991 Frank et al.
5,048,687 A 9/1991 Suzuki et al.
5,067,612 A 11/1991 Tsuchiya et al.
5,163,558 A 11/1992 Palumbo et al.
5,232,118 A 8/1993 Samuel
5,282,687 A 2/1994 Yee
5,346,311 A 9/1994 Siler et al.
5,361,905 A 11/1994 McQueeny et al.
5,380,094 A * 1/1995 Schmidt et al. ..... 383/209
5,467,894 A 11/1995 Altonen et al.

(Continued)

FOREIGN PATENT DOCUMENTS

EP 0 501 260 A1 * 9/1992

(Continued)

OTHER PUBLICATIONS

"International Search Report for corresponding PCT Application No. PCT/US2006/001217", (May 16, 2006), 4 pgs.

*Primary Examiner*—David T. Fidei
(74) *Attorney, Agent, or Firm*—Dority & Manning, P.A.

(57) ABSTRACT

Some example embodiments of the present invention relate to a package that includes a bag and a plurality of absorbent articles that are stored within the bag. The bag includes a plurality of sidewalls and a bottom portion that is connected to each of the sidewalls. The bag further includes a resilient member that extends through each sidewall such that the resilient member forms an adjustable opening in the bag. In some forms, the absorbent articles are diapers that are folded and arranged in a parallel configuration within the bag. Some other example absorbent articles include diapers, feminine hygiene articles, pull-ups, incontinent pads and training pants (among others). The package is able to adequately store disposable absorbent articles once the package has been opened. Therefore, the package eliminates the labor which is typically required to move the disposable absorbent articles from the opened package to another container.

15 Claims, 4 Drawing Sheets

U.S. PATENT DOCUMENTS

| | | | | |
|---|---|---|---|---|
| 5,722,774 | A | 3/1998 | Hartz | |
| 5,788,076 | A * | 8/1998 | Simmons | 206/459.5 |
| 5,934,470 | A * | 8/1999 | Bauer et al. | 206/494 |
| 5,967,665 | A | 10/1999 | MacDonald et al. | |
| 6,213,645 | B1 | 4/2001 | Beer | |
| 6,318,555 | B1 | 11/2001 | Kuske | |
| 6,397,560 | B1 | 6/2002 | Weder | |
| 6,454,095 | B1 * | 9/2002 | Brisebois et al. | 206/494 |
| 6,491,165 | B2 | 12/2002 | Kuske | |
| 6,561,696 | B1 | 5/2003 | Rusnak et al. | |
| 6,601,705 | B2 | 8/2003 | Molina | |
| 6,626,570 | B2 | 9/2003 | Fox et al. | |
| 6,681,934 | B2 | 1/2004 | Kolterjohn et al. | |
| 6,708,823 | B2 | 3/2004 | Cottingham et al. | |
| 6,840,401 | B2 * | 1/2005 | Amundson | 221/56 |
| 2002/0148749 | A1 * | 10/2002 | Briseboi et al. | 206/440 |
| 2002/0175094 | A1 * | 11/2002 | Campbell et al. | 206/233 |
| 2002/0177380 | A1 | 11/2002 | Forman et al. | |
| 2003/0142887 | A1 | 7/2003 | Sleight et al. | |
| 2004/0102748 | A1 | 5/2004 | Hirotsu | |
| 2006/0096880 | A1 * | 5/2006 | Zander et al. | 206/440 |
| 2006/0229581 | A1 * | 10/2006 | Ulas et al. | 604/385.02 |

FOREIGN PATENT DOCUMENTS

| | | | |
|---|---|---|---|
| EP | 1 074 481 | A1 | 5/2001 |
| EP | 1 252 073 | B1 | 6/2003 |
| WO | WO-01/32824 | A1 | 5/2001 |
| WO | WO-02/094678 | | 11/2002 |
| WO | WO-2006112901 | A1 | 10/2006 |

* cited by examiner

PACKAGE THAT INCLUDES A PLURALITY OF DISPOSABLE ABSORBENT ARTICLES

FIELD

The present invention relates to a package, and more particularly to a package that includes a plurality of disposable absorbent articles.

BACKGROUND

Many different types of packages are used to store disposable absorbent articles. Most conventional packages store disposable absorbent articles in a manner that makes it difficult to use the package to store the disposable absorbent articles once the package is opened. Therefore, the disposable absorbent articles are often transferred from the package to another container once the package is opened.

One of the drawbacks with conventional packages is that additional effort is required to transfer the disposable absorbent articles from the package to another container. In addition, the extra container may take up valuable space within an area where the disposable absorbent articles are stored.

Another drawback with conventional packages is that they are typically unable to change size. Therefore, these types of packages become too large to properly store the disposable absorbent articles as some of the disposable absorbent articles are removed from the package. As an example, if half of the disposable absorbent articles are removed from the package, the remaining half of the disposable absorbent articles may be left to flop around in an unnecessarily large package.

In addition, there are often times when it is desirable to transport a reduced amount of disposable absorbent articles from one location to another. Since most packages are unable to change size, they are usually not well suited to transport differing amounts of disposable absorbent articles from one location to another.

Accordingly, there is a need for a package that is able to adequately store disposable absorbent articles once the package has been opened. The package should also be able to change size such that the package is able to properly store the disposable absorbent articles even as some of the disposable absorbent articles are removed from the package.

SUMMARY OF THE INVENTION

The present invention relates to a package that includes a plurality of disposable absorbent articles. The package is able to adequately store disposable absorbent articles once the package has been opened. In addition, the package allows a user to adequately store differing amounts of disposable absorbent articles.

In one aspect, the present invention relates to a package that includes a bag and a plurality of absorbent articles that are stored within the bag. The bag includes a plurality of sidewalls and a bottom portion that is connected to each of the sidewalls. The bag further includes a resilient member that extends through each of the sidewalls such that the resilient member forms an adjustable opening in the bag.

In some forms, the absorbent articles are diapers that are folded and arranged in a parallel configuration within the bag. Some other example absorbent articles include diapers, feminine hygiene articles, incontinent briefs, pull-ups, incontinent pads and training pants (among others).

The package is able to adequately store disposable absorbent articles once the package has been opened. Therefore, the package eliminates the labor which is typically required to move the disposable absorbent articles from the opened package to another container.

In another aspect, the present invention relates to a package that includes a bag having a plurality of sidewalls and a bottom portion connected to each sidewall. The bag further includes a resilient member that extends through each of the sidewalls at a top end of each sidewall. The resilient member forms an adjustable opening within the bag.

The system further includes a plurality of absorbent articles that are stored within the bag. A portion of each absorbent article extends through the opening in the bag and is outside the bag. The resilient member compresses the plurality of absorbent articles such that the resilient member contracts as each absorbent article is removed from the bag. Since the resilient member is able to change size, the package may be used to transport differing amounts of disposable absorbent articles from one location to another.

In some sample forms of the package, the resilient member may be an elastic band. The elastic band may close the bag when none of the absorbent articles are positioned within the adjustable opening in the bag.

In yet another aspect, the present invention relates to a package that includes a bag and a plurality of absorbent articles that are stored within the bag. The bag includes a plurality of sidewalls and a bottom portion that is connected to each of the sidewalls. The bag further includes a resilient member that extends through each sidewall such that the resilient member forms an adjustable opening in the bag. The system further includes a wrapping that encloses the bag and the plurality of absorbent articles.

In some sample forms of the package, the wrapping is a shrink-wrapping that is formed onto the bag and the plurality of absorbent articles. The wrapping may be formed of a transparent material that permits inspection of the bag and the plurality of absorbent articles.

The purposes and features of the present invention will be set forth in the description that follows. Additional features of the invention will be realized and attained by the product and processes particularly pointed out in the written description and claims hereof, as well as from the appended drawings.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the invention.

BRIEF DESCRIPTION OF THE DRAWINGS

The present invention will be more fully understood, and further features will become apparent, when reference is made to the following detailed description and the accompanying drawings. The drawings are merely representative and are not intended to limit the scope of the claims. Like parts depicted in the drawings are referred to by the same reference numerals.

DETAILED DESCRIPTION OF THE INVENTION

The following detailed description references the accompanying drawings which show some example embodiments of the present invention. These embodiments are described in sufficient detail to enable those skilled in the art to practice the invention. It is to be understood that other embodiments may be utilized, or structural changes may be made, such that the detailed description should not to be regarded as limiting the scope of the claims.

Figure 1:
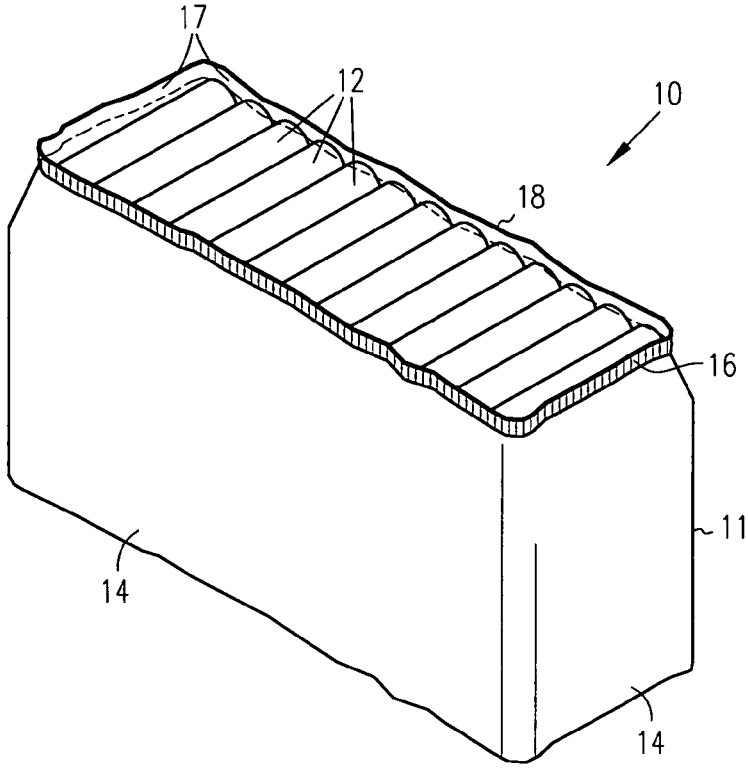
FIG. 1 is a perspective view of an example package of the present invention.

FIG. 1 illustrates a package 10 that includes a bag 11 and a plurality of disposable absorbent articles 12 that are stored within the bag 11. The bag 11 includes a plurality of sidewalls 14 and a bottom portion (not visible with the Figures) that is connected to each of the sidewalls 14. The bag further includes a resilient member 16 that extends through each of the sidewalls 14. The resilient member 16 has some elasticity such that the resilient member 16 forms an adjustable opening 17 in the bag 11.

It should be noted the package 10 may include other conventional elements that allow the package 10 to be opened in some manner. The package 10 has the ability to adequately store the disposable absorbent articles 12 once the package 10 has been opened. The ability of the package 10 to store the disposable absorbent articles 12 eliminates the labor that would otherwise be required to move the disposable absorbent articles 12 from some other package to another container.

As used herein, the term absorbent article refers to devices which absorb and contain body exudates. The absorbent articles are designed to be placed against the body of a wearer such that the absorbent articles absorb and contain the various body fluid or exudates which are discharged from the body. Disposable absorbent articles are absorbent articles which are not intended to be laundered or otherwise reused as an absorbent article (i.e., they are single use devices). Some example disposable articles include diapers, feminine hygiene articles, incontinent briefs, pull-ups, incontinent pads and training pants (among others).

In the example package 10 that is illustrated in FIG. 1, the plurality of absorbent articles 12 are diapers 12 that are folded and arranged in a parallel configuration within the bag 11, although other configurations and orientations that facilitate storing the diapers 12 within the bag 11 are contemplated. In some embodiments, each of the disposable absorbent articles 12 may include an individual wrapper or bag (not shown in the Figures) which contains one of the respective absorbent articles 12.

FIG. 1 shows that the resilient member 16 may extend through each of the sidewalls 14 at a top end 18 of each sidewall 14. It should be noted that other embodiments are contemplated where the resilient member 16 extends through each sidewall 14 at some area other than the top end 18 of each sidewall 14 (see, e.g., resilient member 16 in FIG. 2).

The resilient member 16 may be any device that has some elasticity. The amount of elasticity will depend on the type and size of bag 11 and the type and size of absorbent articles 12 that are used in the package 10. In some embodiments, the resilient member 16 may be an elastic band that fully closes when the resilient member 16 is in a relaxed state. The resilient member 16 may then be expanded to form the opening 17. In other embodiments, the resilient member 16 may form a relatively small opening when the resilient member 16 is in a relaxed state.

Although the bag 11 may be made from any conventional material (e.g., polyethylene), the appropriate material will be determined by the particular needs of an application for the package 10. It should be noted that a portion (or all) of the bag 11 may be transparent to facilitate observing the absorbent articles 12 within the bag 11. In addition, the bag 11 may include any number of sidewalls 14 (four sidewalls are shown in the Figures). In some embodiments, the bottom portion of the bag 11 may be a bottom wall that includes one or more expandable gussets (note that the bottom portion of the bag 11 is not visible in the Figures).

Figure 2:
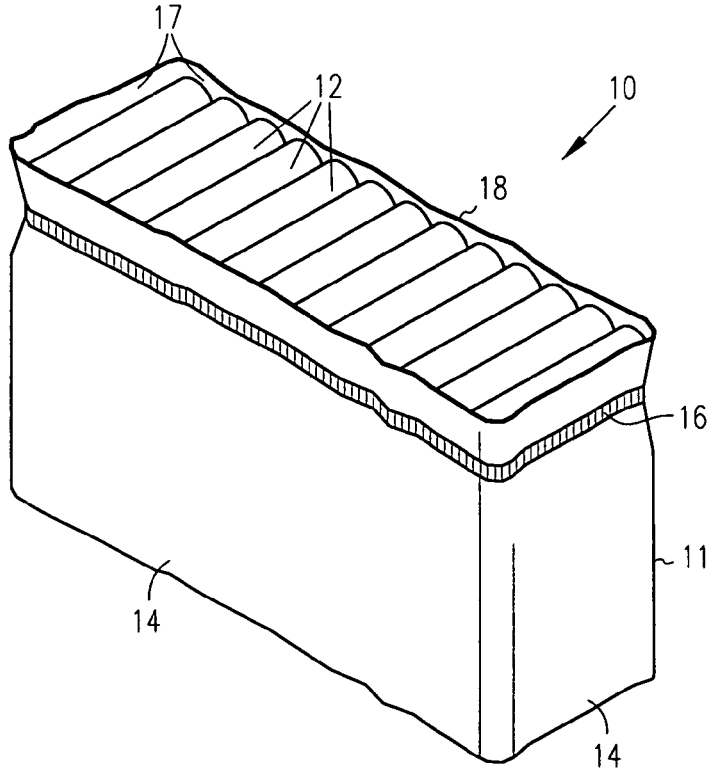
FIG. 2 is a perspective view of another example package of the present invention.
Figure 3:
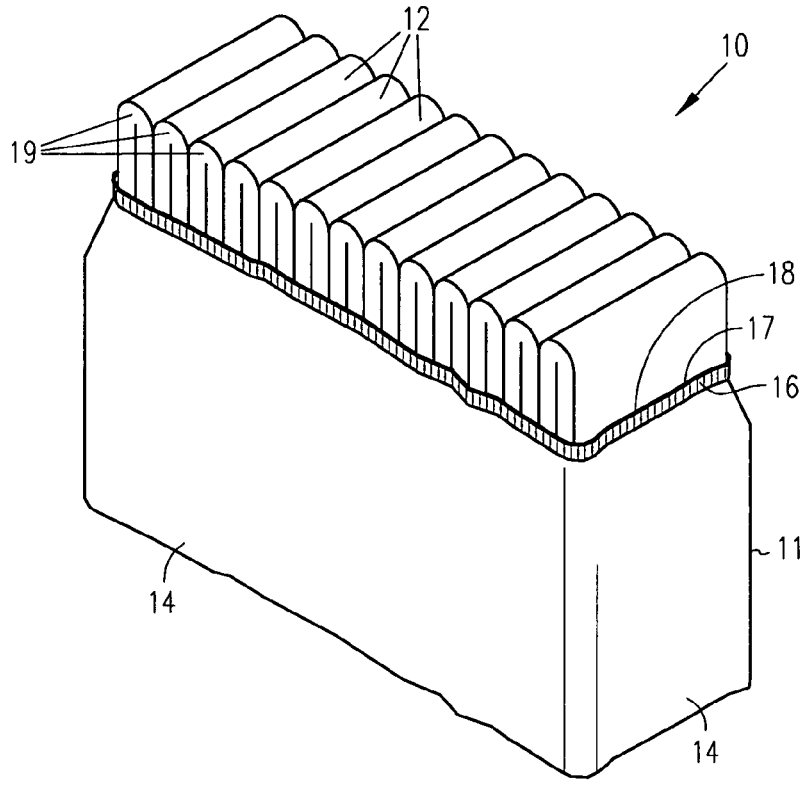
FIG. 3 is a perspective view of another example package of the present invention.
Figure 4:
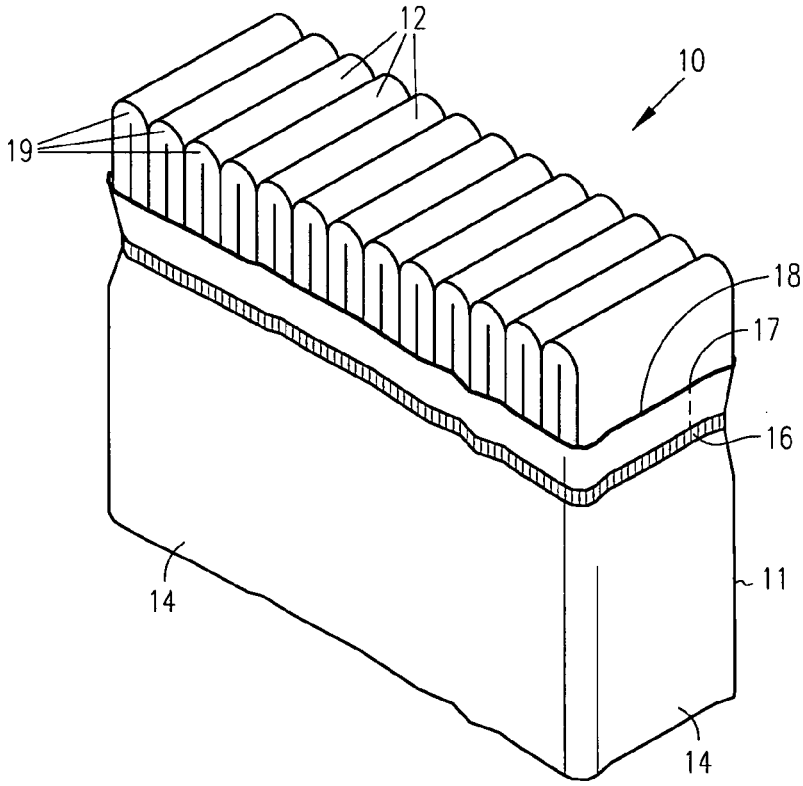
FIG. 4 is a perspective view of another example package of the present invention.

A comparison of FIGS. 1 and 2 with FIGS. 3 and 4 demonstrates that in some embodiments, the diapers 12 may be entirely within the bag 11 (FIGS. 1 and 2), while in other embodiments, a portion 19 of each diaper 12 is outside the bag 11 (FIGS. 3 and 4). It should be noted that when a portion of each diaper 12 is outside the bag 11 the size of the opening 17 may be determined in part by the number of diapers 12 that are within the opening 17.

FIG. 3 shows an example embodiment where the resilient member 16 extends through each of the sidewalls 14 at a top end 18 of each sidewall 14. FIG. 4 shows an alternative example embodiment where the resilient member 16 extends through each sidewall 14 at some area other than the top end 18 of each sidewall 14.

In the example embodiments that are illustrated in FIGS. 3 and 4, the resilient member 16 compresses the diapers 12 such that the resilient member 16 secures the diapers 12 within the bag 11. Since a portion 19 of each diaper 12 is extending through the opening 17, a user is able to easily grasp a portion 19 of a particular diaper 12 when they want to remove the particular diaper 12 from the bag 11.

Figure 5:
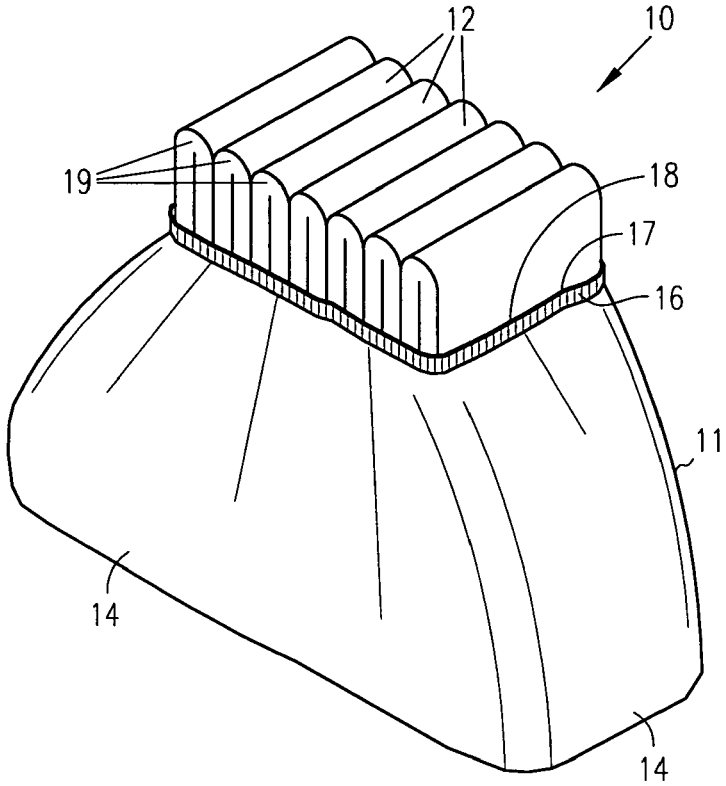
FIG. 5 is a perspective view of the package shown in FIG. 3 with some of the disposable absorbent articles removed form the package.

FIG. 5 shows that the resilient member 16 contracts as some of the individual diapers 12 are removed from the bag 11. Therefore, the opening 17 in the bag 11 becomes smaller as more diapers 12 are removed from the opening 17.

Figure 6:
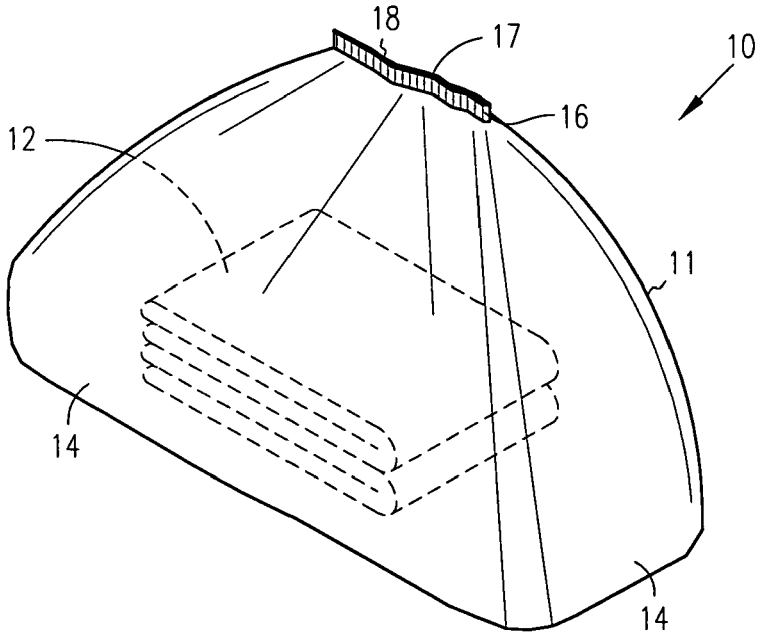
FIG. 6 is a perspective view of the package shown in FIG. 5 with more of the disposable absorbent articles removed form the package.

FIG. 6 shows that the opening 17 may close completely when more of the diapers 12 are removed from the bag 11 and the remaining diapers 12 are oriented such that they are within the bag 11 but not within the opening 17. It should be noted that the opening 17 may also close completely when all of the diapers 12 are removed from the bag.

As discussed above, in some embodiments the resilient member 16 may not close completely when all of the diapers 12 are removed from the opening 17. The opening 17 may be sized such that it is small enough to prevent one or more diapers 12 from falling out of the bag 11.

Since the resilient member 16 is able to expand and contract, the package 10 is able to change size. As shown in FIG. 6, the package 10 may be used to transport disposable absorbent articles 12 from one location to another. It should be noted that since the resilient member 16 is able to change size, the package 10 is able to adequately transport differing amounts of absorbent articles.

Figure 7:
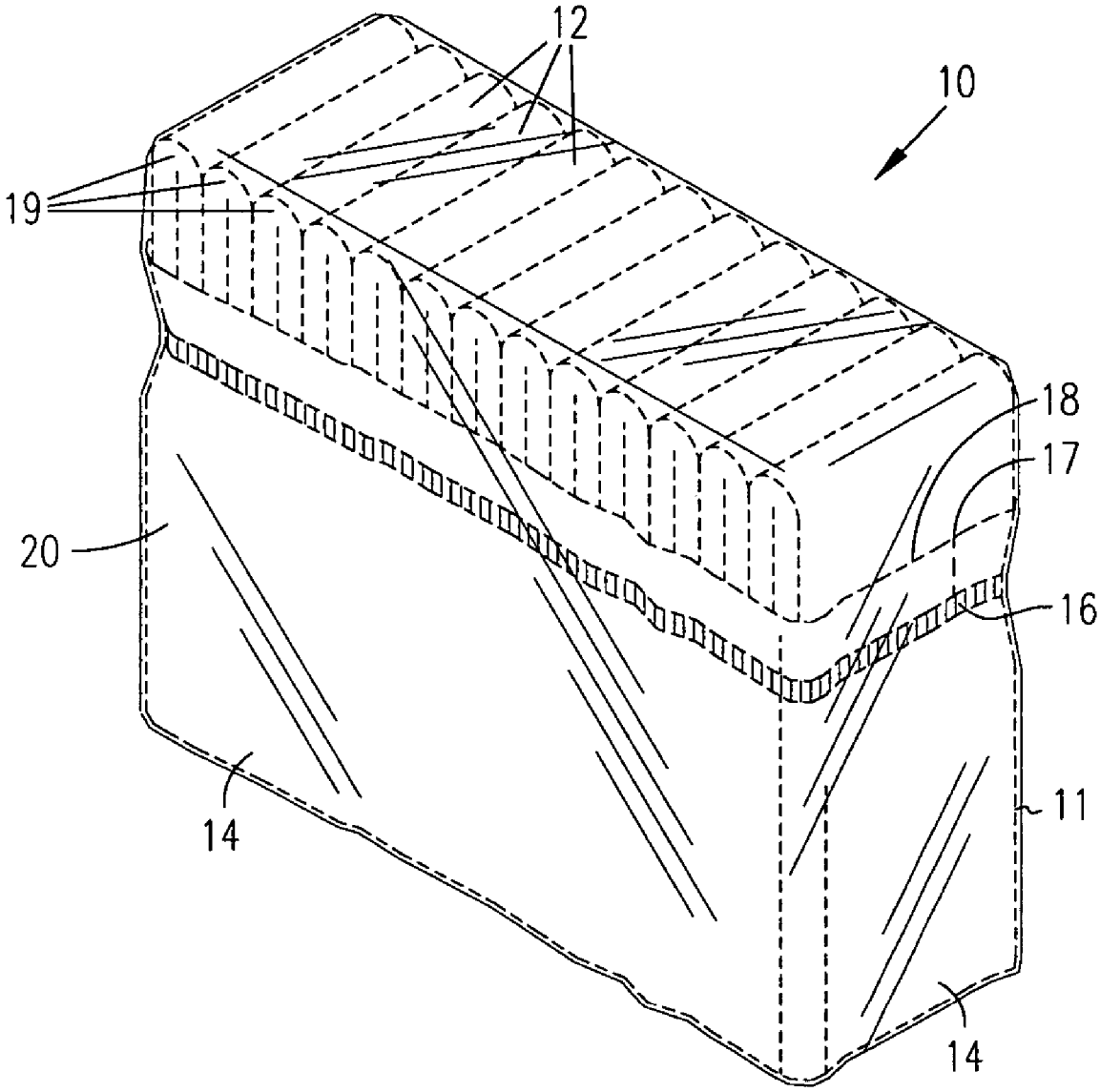
FIG. 7 is a perspective view of another example package of the present invention.

FIG. 7 shows that the package 10 may further include a wrapping 20 that encloses the bag 11 and the plurality of absorbent articles 12. In some embodiments, the wrapping 20 may be a shrink-wrapping that is formed onto the bag 11 and the plurality of absorbent articles 12. The wrapping 20 may initially be removed from the package 10 to open the package 10 such that the bag 11 subsequently serves to secure the absorbent articles 12 by itself.

It should be noted that the wrapping 20 may be formed at least in part of a transparent material that permits inspection of the bag 11 and the plurality of absorbent articles 12. The size and shape of the wrapping 20 will depend on the applications where the package 10 may be used (among other factors). As examples, the wrapping 20 may enclose the entire bag 11 and absorbent articles 12, or portions of the bag 11 and absorbent articles 12.

FIGS. 1-7 are representational and are not necessarily drawn to scale. Certain proportions thereof may be exaggerated, while others may be minimized.

The packages described herein may eliminate (i) the labor that is typically required to remove absorbent articles from a package; and (ii) the need for an extra container to store the absorbent articles once they are removed from the package. The packages may also have the ability to change size such that the packages may be used to transport differing amounts of disposable absorbent articles from one location to another.

While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

I claim:

1. A package comprising:

a bag that includes a plurality of sidewalls and a bottom portion connected to each of the sidewalls, the bag further including a resilient member that extends through each of the sidewalls such that the resilient member forms an adjustable opening in the bag; and a plurality of absorbent articles stored within the bag, wherein a portion of each absorbent article is outside the bag.

2. The package of claim 1 wherein the resilient member compresses the plurality of absorbent articles such that the resilient member contracts as individual absorbent articles are removed from the bag.

3. A package comprising:

a bag that includes a plurality of sidewalls and a bottom portion connected to each of the sidewalls, the bag further including a resilient member that extends through each sidewall at a top end of each sidewall, the resilient member forming an adjustable opening in the bag; and a plurality of absorbent articles stored within the bag such that a portion of each absorbent article extends through the opening and is outside the bag, the resilient member compressing the plurality of absorbent articles such that the resilient member contracts as each absorbent article is removed from the bag.

4. The package of claim 3 wherein each absorbent article is a diaper that is folded and arranged in a parallel configuration with other diapers in the bag.

5. The package of claim 3 wherein the resilient member is an elastic band.

6. The package of claim 3 wherein the plurality of sidewalls includes four sidewalls.

7. The package of claim 3 wherein the resilient member closes the bag when none of the absorbent articles are positioned within the opening.

8. A package comprising:

a bag that includes a plurality of sidewalls and a bottom portion connected to each of the sidewalls, the bag further including a resilient member extending through each of the sidewalls such that the resilient member forms an adjustable opening in the bag;

a plurality of absorbent articles that are stored within the bag; and a wrapping that encloses the bag and the plurality of absorbent articles.

9. The package of claim 8 wherein each absorbent article is a diaper that is folded and arranged in a parallel configuration with other diapers in the bag.

10. The package of claim 8 wherein the wrapping is a shrink-wrapping that is formed onto the bag and the plurality of absorbent articles.

11. The package of claim 8 wherein the wrapping is formed of a transparent material that permits inspection of the bag and the plurality of absorbent articles.

12. The package of claim 8 wherein a portion of each absorbent article extends through the opening in the bag and is outside the bag.

13. The package of claim 12 wherein the resilient member closes the bag when none of the absorbent articles are positioned within the opening.

14. The package of claim 12 wherein the resilient member compresses the plurality of absorbent articles such that the resilient member contracts as individual absorbent articles are removed from the bag.

15. The package of claim 8 wherein the resilient member extends through each of the sidewalls at a top end of each sidewall.

* * * * *